US011788793B1

(12) United States Patent
Kelly et al.

(10) Patent No.: US 11,788,793 B1
(45) Date of Patent: Oct. 17, 2023

(54) RECUPERATOR WITH BALANCED AND FLOATING CORE

(71) Applicants: Kevin Kelly, Baton Rouge, LA (US); Cole Doiron, Denham Springs, LA (US)

(72) Inventors: Kevin Kelly, Baton Rouge, LA (US); Cole Doiron, Denham Springs, LA (US)

( * ) Notice: Subject to any disclaimer, the term of this patent is extended or adjusted under 35 U.S.C. 154(b) by 0 days.

(21) Appl. No.: 17/213,479

(22) Filed: Mar. 26, 2021

(51) Int. Cl.
*F28D 7/16* (2006.01)
*F28D 21/00* (2006.01)

(52) U.S. Cl.
CPC ..... *F28D 7/1669* (2013.01); *F28D 21/0001* (2013.01)

(58) Field of Classification Search
CPC ..... F28F 2265/06; F28F 2009/226; F28F 9/0241; F28D 7/1669
See application file for complete search history.

(56) References Cited

U.S. PATENT DOCUMENTS 3,301,321 A * 1/1967 Poore ..... F28F 21/062 165/158
3,494,414 A * 2/1970 Warner ..... F28F 9/22 165/158
4,190,101 A * 2/1980 Hartmann ..... F28F 21/067 165/158
4,357,991 A * 11/1982 Cameron ..... F28F 9/22 165/159
6,206,086 B1 * 3/2001 McKey ..... F28F 9/0241 165/158
2002/0162651 A1 * 11/2002 Nakagome ..... F28F 9/0229 165/158

* cited by examiner

*Primary Examiner* — Tho V Duong
(74) *Attorney, Agent, or Firm* — Emily L. Gordy; Carver, Darden, Koretzky, Tessier, Finn, Blossman & Areaux, LLC

(57) ABSTRACT

A microtube recuperator for transferring heat between a high pressure fluid stream and a low pressure fluid.

7 Claims, 7 Drawing Sheets

RECUPERATOR WITH BALANCED AND FLOATING CORE

STATEMENT OF FUNDING

The U.S. Government has provided support for the making of, and has certain rights in, this invention as provided for by the terms of Contract No. DE-AR0001118 awarded by the U.S. Department of Energy.

BACKGROUND OF THE INVENTION

Carbon dioxide usually behaves as a gas in air at standard temperature and pressure (STP) (or as a solid called dry ice when frozen). However, if the temperature and pressure are both increased from STP to be at or above the critical point for carbon dioxide (resulting in supercritical carbon dioxide ($sCO_2$)), it can adopt properties midway between a gas and a liquid.

Power cycles based on $sCO_2$ as the working fluid have the potential to yield higher thermal efficiencies at lower capital cost that many steam-based power cycles. Recuperators within these power cycles are used to increase the efficiency of the system by using the exhaust heat from the turbine to pre-heat $CO_2$ from the compressor before further heating in the combustor, thereby reducing the fuel input required.

High efficiency $sCO_2$-based power cycles may involve very aggressive combinations of temperature and pressure (for example, around 800° C. and 3800 psi). Recuperators for these $sCO_2$ systems, which are key and necessary components of these power cycles, can be extremely expensive, primarily due to extreme materials and manufacturing costs required to handle the aggressive combinations of high temperature and high pressure.

The present invention of a recuperator with a floating and balanced core is capable of safely handling the aforementioned aggressive temperatures and pressures while also providing for a compact and low cost design. The recuperator of the present invention comprises a floating core that decouples the thermal expansion mismatch between the recuperator shell and the recuperator core. Additionally, the multiple shell passes minimize differences in axial thermal strain within the core of the recuperator. Further, the balanced core ensures only a very slight tensile load in the tubes within the core exists during steady-state operation. Moreover, all sources of stress on tubes are greatly reduced, or eliminated, except for circumferential stress associated with different between tube-side and shell-side pressure. Finally, yet another advantage of the instant invention is the straightforward assembly process.

These and other embodiments and features of the present invention will become even more apparent from the following detailed description of various embodiments, the accompanying figures and the appended claims.

SUMMARY OF THE INVENTION

In one embodiment, the present invention comprises a recuperator for transferring heat between a high pressure fluid stream and a low pressure fluid stream. The recuperator comprises an annular core comprising a plurality of parallel microtubes wherein each microtube comprises a hot end and a cold end. The core further comprises a series of baffles perpendicular to said microtubes and wherein said series of baffles comprises alternating hollow baffles and solid baffles. The recuperator also comprises an outer void surrounding said annular core and a shell surrounding said outer void.

The shell comprises a hot end and a cold end wherein said shell further comprises a low pressure inlet at said cold end of said shell and a low pressure outlet at said hot end of said shell. The recuperator also comprises a hot end tube sheet located adjacent to said hot ends of said micotubes and wherein said microtube hot ends extend into said hot end tube sheet, and a hot end end cap wherein said hot end end cap is adjacent to said hot end of said shell and wherein said hot end tube sheet is fixed to said hot end end cap. The hot end end cap further comprises at least one hot end exit port and a high pressure outlet wherein said hot end exit port connects said hot ends of said microtubes to said high pressure outlet. The recuperator further comprises a cold end tube sheet located adjacent to said cold ends of said microtubes and wherein said microtube cold ends extend into said cold end tube sheet, and a cold end end cap wherein said cold end end cap is adjacent to said cold end of said shell and wherein said cold end tube sheet is not fixed to said cold end end cap. In the recuperator a void also exists between said cold end tube sheet and said cold end end cap. The cold end end cap further comprises at least one cold end entry port and a high pressure inlet wherein said cold end entry port connects said cold ends of said microtubes to said cold end entry ports.

In another embodiment, the present invention comprises a recuperator for transferring heat between a high pressure fluid stream and a low pressure fluid stream comprising an annular core having a length and comprising a plurality of parallel microtubes wherein each microtube comprises a hot end and a cold end and wherein said microtubes are capable of transporting said high pressure fluid along said length of said core. The core further comprises a series of baffles perpendicular to said microtubes and wherein said series of baffles comprises alternating hollow baffles and solid baffles capable of directing said low pressure fluid stream radially inwards and outwards as said lower pressure fluid stream travels along said length of said core. A shell surrounds said core wherein said shell comprises a hot end and a cold end wherein said shell further comprises a low pressure inlet at said cold end of said shell and a low pressure outlet at said hot end of said shell. A hot end tube sheet is located adjacent to said hot ends of said micotubes and said microtube hot ends extend into said hot end tube sheet. The recuperator further comprises a hot end end cap wherein said hot end end cap is adjacent to said hot end of said shell and wherein said hot end tube sheet is fixed to said hot end end cap. The hot end end cap further comprises at least one hot end exit port and a high pressure outlet wherein said hot end exit port connects said hot ends of said microtubes to said high pressure outlet. The recuperator also comprises a cold end tube sheet located adjacent to said cold ends of said microtubes and said microtube cold ends extend into said cold end tube sheet and wherein said cold end tube sheet is capable of moving axially. The recuperator further comprises a cold end end cap wherein said cold end end cap is adjacent to said cold end of said shell and permits said axial movement of said cold end tube sheet. The cold end end cap further comprises at least one cold end entry port and a high pressure inlet wherein said cold end entry port connects said cold ends of said microtubes to said cold end entry ports.

Figure 1:
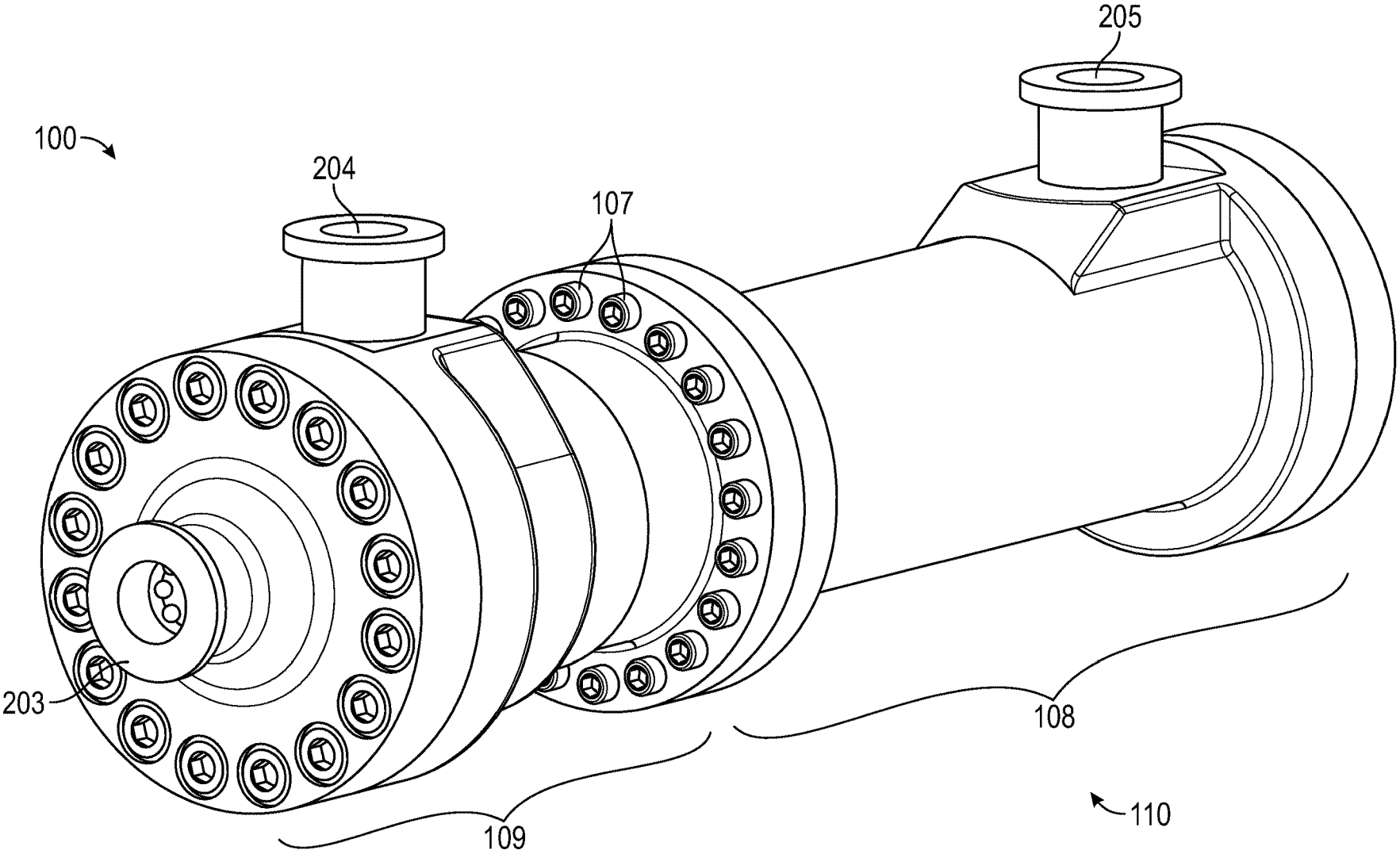
FIG. 1 is an exterior view of an embodiment of the present invention.

The images in the drawings are simplified for illustrative purposes. Within the descriptions of the figures, similar elements are provided similar names and reference numerals as those of the previous figure(s). The specific numerals assigned to the elements are provided solely to aid in the description and are not meant to imply any limitations (structural or functional) on the invention.

The appended drawings illustrate exemplary configurations of the invention and, as such, should not be considered as limiting the scope of the invention that may admit to other equally effective configurations. It is contemplated that features of one configuration may be beneficially incorporated in other configurations without further recitation.

DETAILED DESCRIPTION OF THE INVENTION

Recuperator Elements:

FIG. 1 shows an exterior view of an embodiment of a recuperator 100 of the present invention. A recuperator 100 is comprised of an exterior shell 110. In one embodiment, as shown in FIG. 1, the shell 110 comprises two separate physical sections, the cold end shell 108 and the hot end shell 109, that are joined by bolts 107. However, in alternate embodiments, the cold end shell 108 and the hot end shell 109 may be comprised of a singular physical shell, or alternatively, if the cold end shell 108 and the hot end shell 109 are comprised of two separate physical sections, they may be joined by welding or other securing means known in the industry.

Figure 2A:
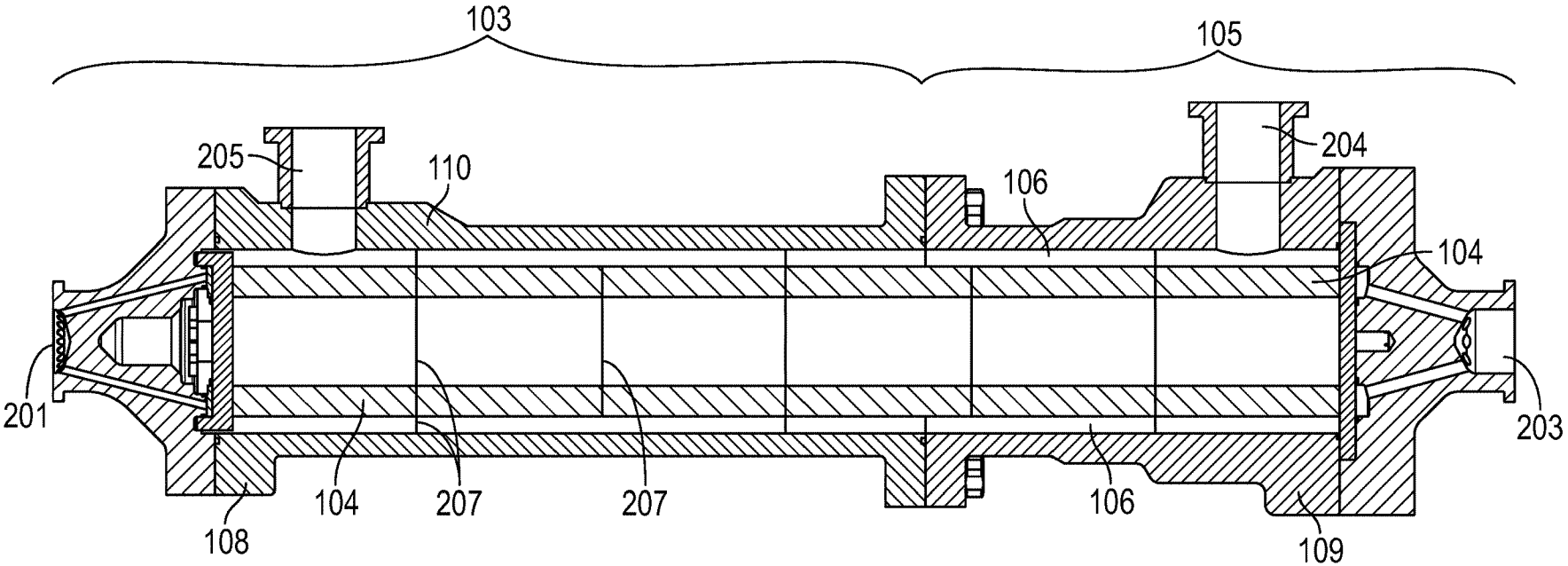
FIG. 2A is a cross-section view of an embodiment of the present invention.
Figure 2B:
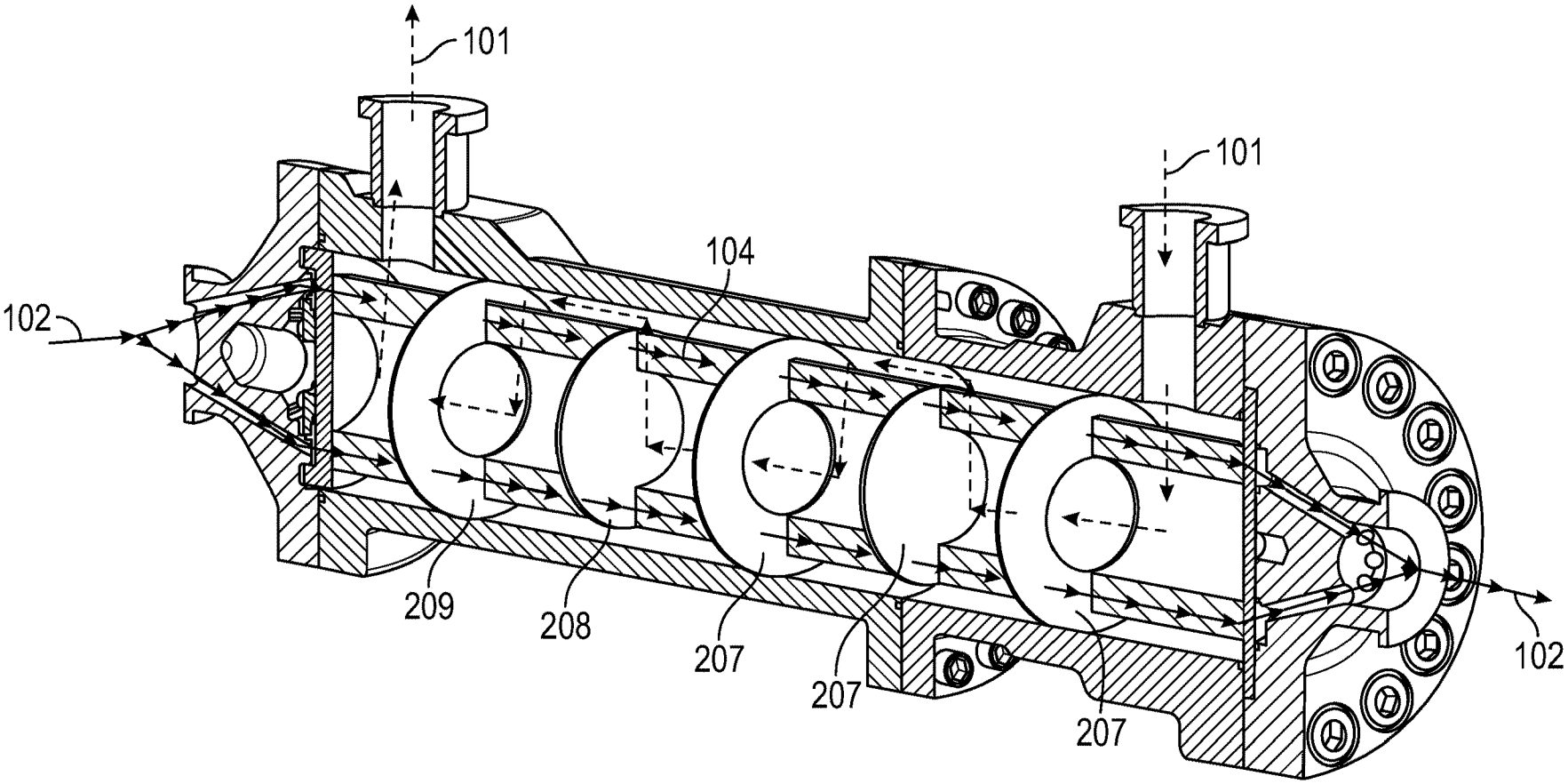
FIG. 2B is an alternate cross-section view of an embodiment of the present showing the flow path of high pressure $CO_2$ and low pressure $CO_2$.

FIGS. 2A and 2B show a cross-section of an embodiment of a recuperator 100 of the present invention. High pressure $CO_2$ 102 enters the recuperator 100 through the high pressure inlet 201 and then into the microtubes 202 (shown in detail in FIG. 5) of the microtube annular core 104 wherein the high pressure $CO_2$ 102 is warmed and eventually exits through the high pressure outlet 203. In one exemplary use of the recuperator 100, the high pressure $CO_2$ 102 enters at approximately 260 bar and 300° C. and exits at approximately 255 bar and 780° C.

Figure 5:
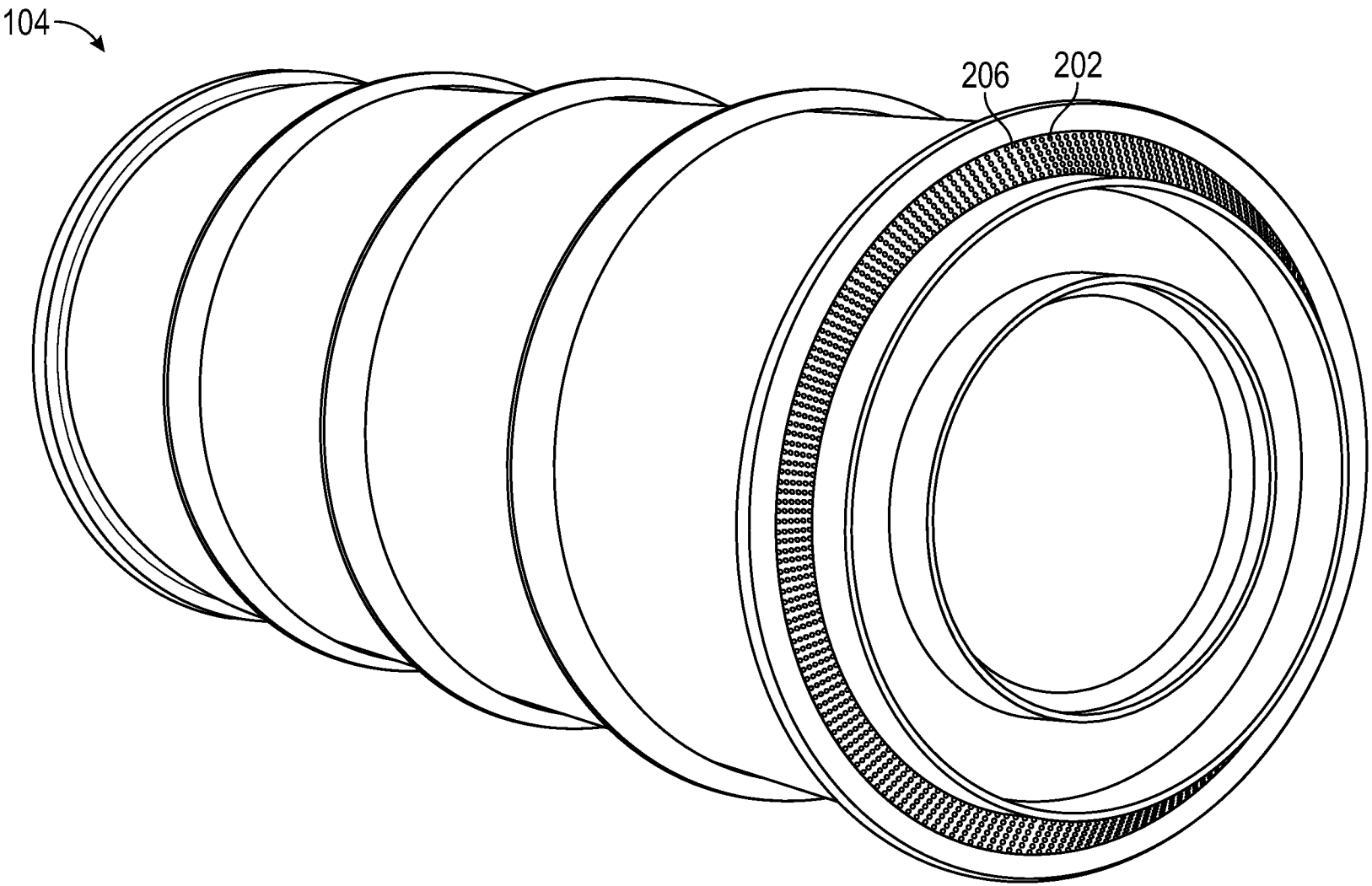
FIG. 5 is a detailed view of the annular core.

Low pressure $CO_2$ 101 enters the recuperator 100 through the low pressure inlet 204, into the microtube annular core 104 (through the voids 206 surrounding the microtubes 202 as shown in FIG. 5) and eventually exits through the low pressure outlet 205. In one exemplary use of the recuperator 100, the low pressure $CO_2$ 101 enters at approximately 80 bar and 800° C. and exits at 78.5 bar and 320° C.

As shown in FIGS. 2A and 2B, the microtube annular core 104 further comprises a series of baffles 207, as shown in FIG. 2. The baffles 207 comprise two different types: a solid baffle 208 and a hollow baffle 209. These baffles 207 are arranged with alternating solid baffles 208 and hollow baffles 209 so to direct the low pressure $CO_2$ 101 (flowing around the microtubes 202) towards the center of the microtube annular core 104 and back towards the exterior of the microtube annular core 104 (said exterior space being the outer void 106 as identified in FIG. 2A) as the low pressure $CO_2$ 101 flows down the length of the core 104. These lateral passes of the low pressure $CO_2$ 101 caused by the baffles 207 results in enhanced heat transfer between the high pressure $CO_2$ 102 and the the low pressure $CO_2$ 101. Additionally, the lateral passes also minimize radial difference in axial thermal strain within the microtube annular core 104. Radial variation of microtube 202 temperature will cause some of the microtubes 202 to expand more than other microtubes 202 thereby putting strain on the welds between the microtubes 202 and connected tube sheets. Thus, the multiple lateral passes assure that the difference in average microtube temperature within the core are minimized thereby resulting in minimal thermal expansion-induced stresses.

FIG. 5 shows an exemplary embodiment of a microtube annular core 104 comprising microtubes 202 extending the length of the core 104 wherein microtubes 202 are surrounded by voids 206. At one end of the core 102, the microtubes 202 are secured to a hot end tube sheet 301 and at the opposite end of the core 102, the microtubes 202 are secured to the cold end tube sheet 310 (as shown in FIGS. 3 and 4). In one embodiment, the ends of the microtubes 202 are secured to the respective tube sheets 301, 310 via laser welding. The microtube annual core 104 of the invention is not limited to the configuration shown in FIG. 5 and may have more or fewer microtubes 202 and may vary in size and shape.

Figure 3A:
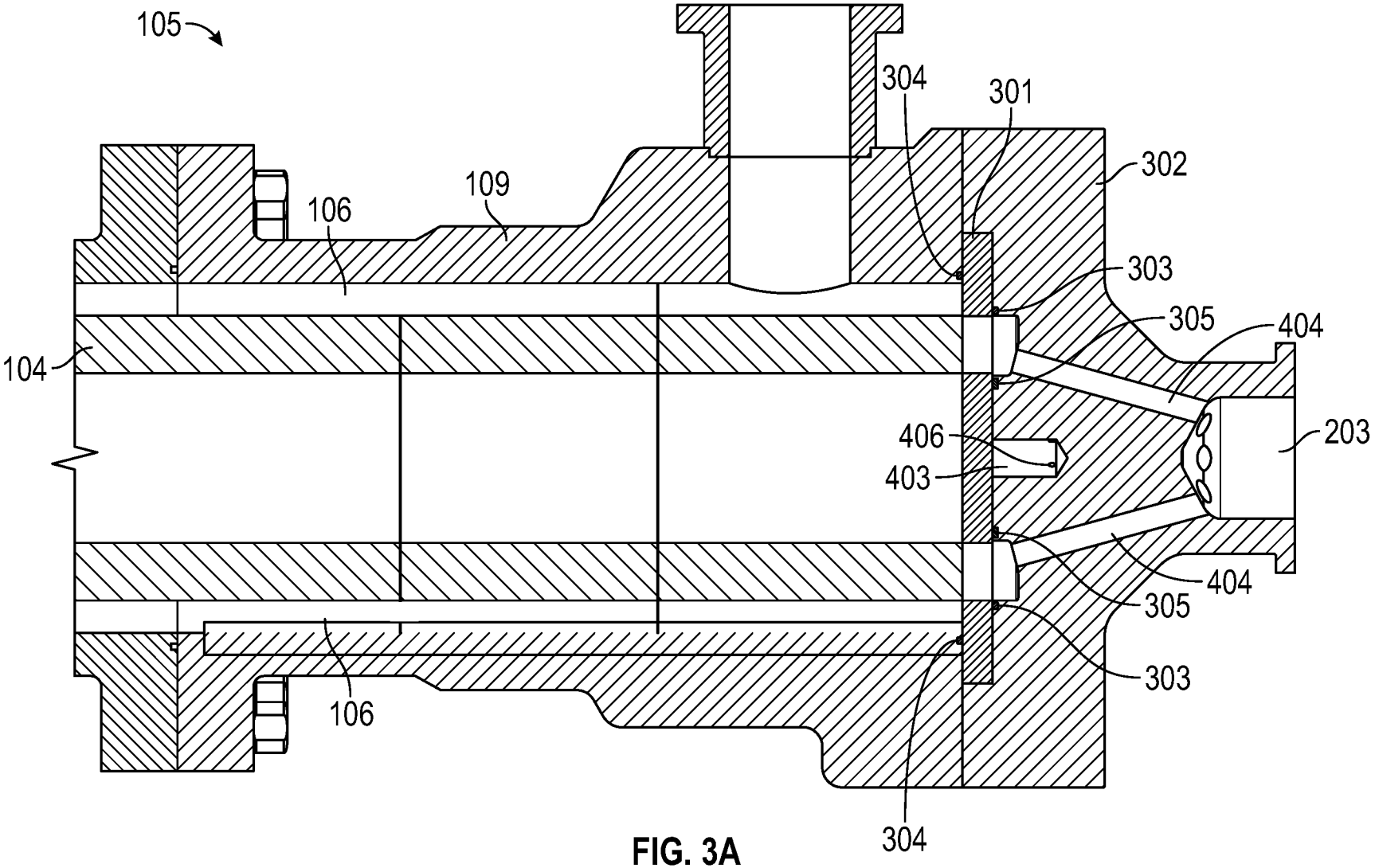
FIG. 3A is a detailed cross-section view of the fixed/hot end of an embodiment of the present invention.
Figure 4:
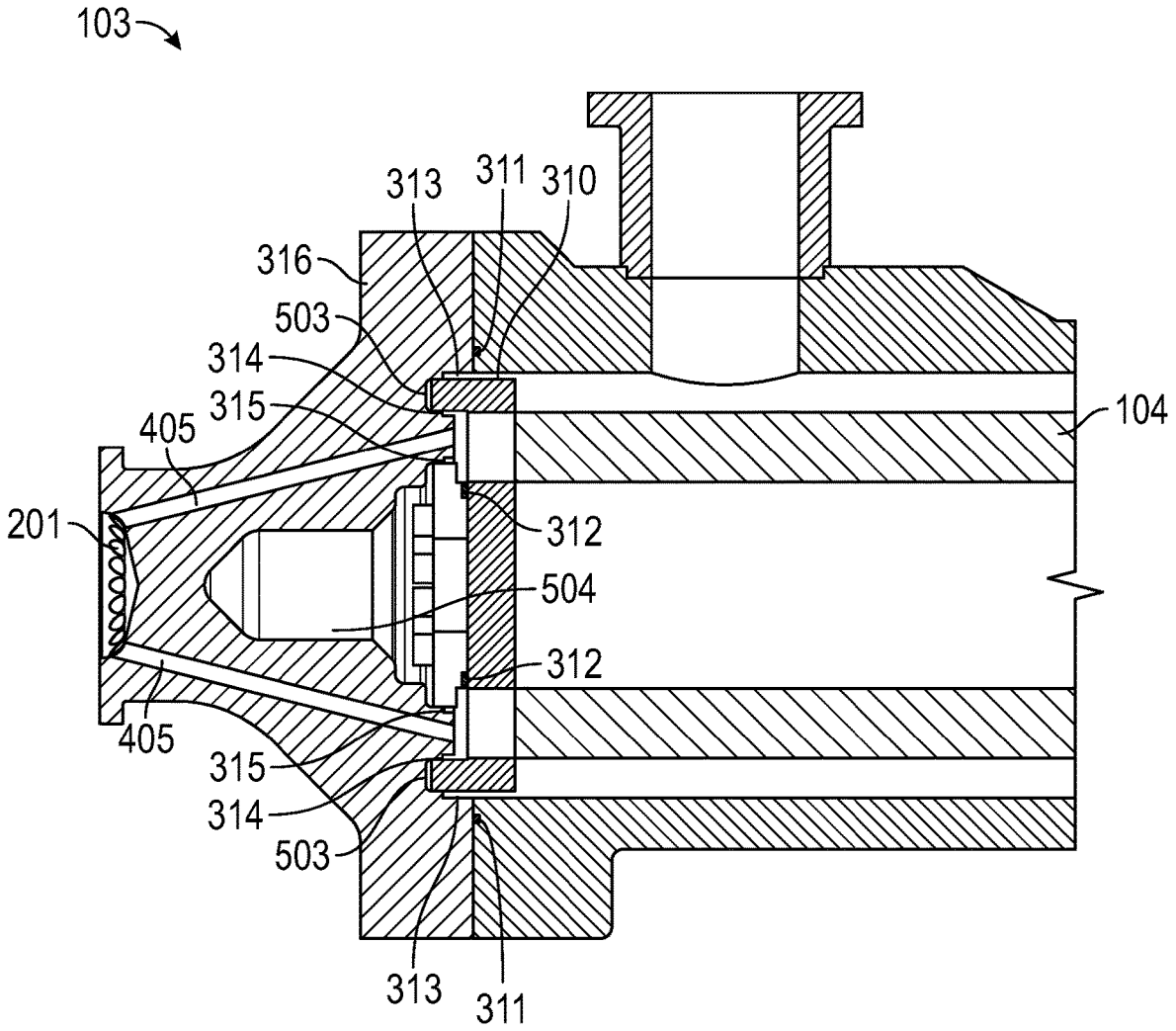
FIG. 4 is a detailed cross-section view of the floating/cold end of an embodiment of the present invention.

FIG. 3A shows an exemplary embodiment of the hot end 105 of the recuperator 100. High pressure $CO_2$ 102 flows out of the recuperator 100 via the hot end exit ports 404 which connect the microtubes 202 to the high pressure outlet 203. The hot end 105 of the core 104 is fixed to the hot end end cap 302 by fitting the hot end tube sheet 301 into an aperture in the hot end end cap 302. The hot end end cap 302 also comprises a hollow bleed cavity 403 capable of capturing and storing any $CO_2$ that may bleed out of the microtube annular core 104. The bleed cavity 403 comprises at least one bleed cavity hole 406 through which $CO_2$ trapped in the bleed cavity 403 may escape to outside of the recuperator 100.

Figure 3B:
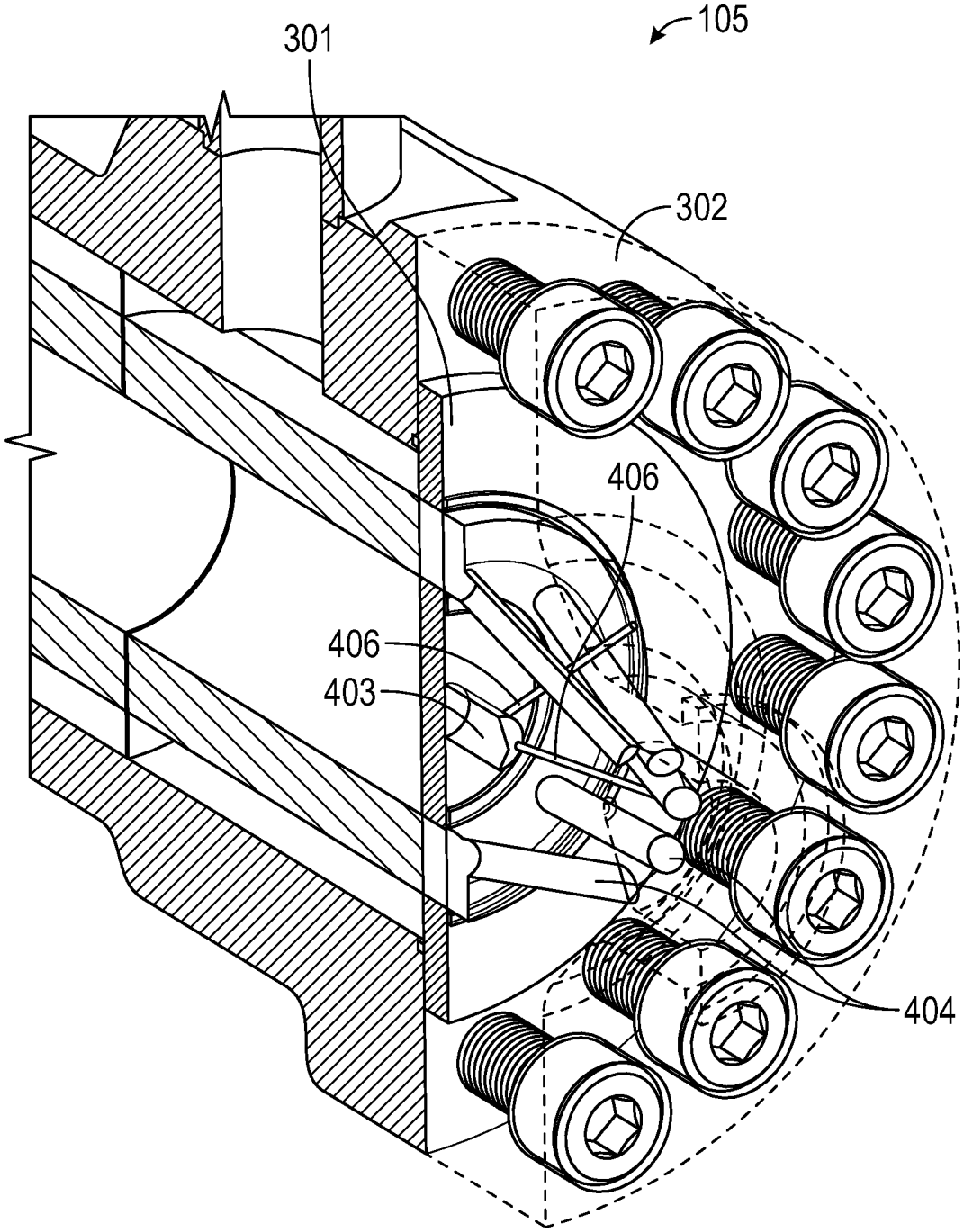
FIG. 3B is an alternate cross-section view of the fixed/hot end of an embodiment of the present invention.

As shown in FIG. 3A, the hot end 105 advantageously further comprises three face seals to prevent leakage of $CO_2$ out of the recuperator 100: the first hot end face seal 303, the second hot end face seal 304 and the third hot end face seal 305. In one embodiment, these hot end face seals, 303, 304, 305 are gaskets/o-rings that seal the adjoining surfaces. The first hot end face seal 303 seals the junction between the outer edge of the hot end exit port 404 where the hot end exit port 404 meets the hot end tube sheet 301. The third hot end face seal 305 seals the junction between the inner edge of the hot end exit port 404 where the hot end exit port 404 meets the hot end tube sheet 301. The second hot end face seal 304 seals the junction where the hot end shell 109 meets the hot end face tubesheet 310 near the outer void 106 surrounding the core 104. FIG. 3B shows an alternate view of the hot end 105. This alternate view depicts the various exit ports 404 connected to the hot end tube sheet 301. This alternate view also depicts multiple bleed cavity holes 406 for transporting $CO_2$ outside the recuperator 100.

FIG. 4 shows an exemplary embodiment of the cold end 103 of the core 104. High pressure $CO_2$ 102 flows into the recuperator 100 via the high pressure inlet 201 which connects to the cold end entry ports 405 and ultimately to the cold end 103 of the microtubes 202. The cold end 103 of the core 104 is considered to be "floating" because the cold end tube sheet 310 is capable of moving axially and is not fixed to the cold end end cap 316. The cold end end cap 316 comprises a hollow cold end cavity 504 capable of collecting and venting any $CO_2$ that may bleed out of the microtube annular core 104. The cold end end cap 316 further comprises cold end tube sheet voids 503 which are void areas between each end of the cold end tube sheet 310 and the cold end end cap 316.

The cold end 103 advantageously further comprises three face seals to prevent leakage of $CO_2$ out of the recuperator 100: the first cold end face seal 311 and the second cold end face seal 312. In one embodiment, these cold end face seals 311, 312 are gaskets that seal the adjoining surfaces. The first cold end face seal 311 seals the junction between the cold end shell 108 and the cold end end cap 316. The second cold end face seal 312 seals the junction between cold end tube sheet 310 and the cold end cavity 504. The cold end 103 further comprises three radial seals: a first cold end radial seal 313, a second cold end radial seal 314 and third cold end radial seal 315. In one embodiment, the three radial seals 313, 314, 315 comprise o-rings and are capable of absorbing relative axial motion between the adjoining elements. The first cold end radial seal 313 seals the junction between the outer edge of the cold end tube sheet 310 and the cold end end cap 316. The second cold end radial seal 314 seals the junction between the inner edge of the cold end tube sheet 310 and the cold end end cap 316. The third cold end radial seal 315 seals the junction between the cold end cavity 504 and the cold end end cap 316.

Floating & Balanced Core:

In other recuperators, the problem of thermal expansion-induced stresses is common and may be a cause of recuperator failure. Specifically, due to the difference in temperatures of the core 104 and the shell 108, 109 the core 104 and shell 108, 109 may expand differently resulting in stress in the areas where the core 104 and shell 108, 109 join. The "floating" nature of the cold end 103 of the core 104 advantageously results in expansion within the core 104 being independent from expansion of the shell 108, 109.

The difference in pressures of the high pressure $CO_2$ and the low pressure $CO_2$ flowing through the recuperator 100, along with the non-uniform temperature field, can also be sources of longitudinal stress within the microtubes. It is advantageous to "balance" the core so that the axial forces associated with the high pressure $CO_2$ and the low pressure $CO_2$ mostly cancel each other out. In one embodiment, microtubes 202 with an outer diameter of 0.060 inches and wall thickness of 0.010 inches, are packed within the annular volume that comprises the core 104. The outer diameter of the annular core is around 200 mm, the inner diameter is around 150 mm. The relatively short radial dimension from the inner diameter of the core 104 to the outer diameter of the core 104 may be beneficial: the area over which high pressure acts on the tube sheets is relatively small and the length scale that defines deformation of the tubesheet due to bending is relatively short, a fact that limits pressure-induced tubesheet deformation for a given tubesheet thickness. The high pressure $CO_2$ tends to place the microtubes 202 in compression and the low pressure $CO_2$ places the microtubes 202 in tension. By balancing the product of area x pressure of both high and low pressure fluids, the net axial force (stress) on the tubes can be minimized.

Recuperator Materials:

Another advantage of the recuperator 100 is the limited use of expensive nickel alloy parts. The recuperator 100 design facilitates a very simple transition from nickel alloys (in, for example, the hot end) to traditional stainless steel when the temperature of the shell and core can accommodate the lower price material options (in, for example, the cold end). In one embodiment, the hot end end cap, hot end tube sheet and hot end shell are comprised of nickel alloy while the cold end end cap, cold end tube sheet and cold end shell are comprised of stainless steel.

As to the microtubes, in one embodiment, the microtubes are made of Haynes 282 super alloy (a wrought, gamma-prime strengthened supper alloy). However, in other embodiments, alloy such as Iconel 625 or Iconel Alloy 740H may be used for the microtubes.

Modular Design:

Another advantage of the recuperator 100 is the modular design. While the assembly of the recuperator 100 may optionally utilize welding, welding is not necessary to secure the hot and cold end end caps, core and the hot and cold end shells. This results in a recuperator that is easy to install and maintain.

That which is claimed is:

1. A recuperator for transferring heat between a high pressure fluid stream and a low pressure fluid stream comprising:

an annular core comprising a plurality of parallel microtubes wherein each microtube comprises a hot end and a cold end and said core further comprises a series of baffles perpendicular to said microtubes and wherein said series of baffles comprises alternating hollow baffles and solid baffles;

an outer void surrounding said annular core;

a shell surrounding said outer void wherein said shell comprises a hot end and a cold end wherein said shell further comprises a low pressure inlet at said cold end of said shell and a low pressure outlet at said hot end of said shell;

a hot end tube sheet located adjacent to said hot ends of said micotubes and wherein said microtube hot ends extend into, and are laser welded to, said hot end tube sheet;

a hot end end cap wherein said hot end end cap is adjacent to said hot end of said shell and wherein said hot end tube sheet is fixed to said hot end end cap and wherein hot end end cap further comprises at least one hot end exit port, a high pressure outlet wherein said hot end exit port connects said hot ends of said microtubes to said high pressure outlet, a hollow bleed cavity, and a bleed cavity hole wherein said hollow bleed cavity is located at the center of said hot end end cap and wherein said bleed cavity hole connects said hollow bleed cavity to outside of said recuperator;

a cold end tube sheet located adjacent to said cold ends of said microtubes and wherein said microtube cold ends extend into, and are laser welded to, said cold end tube sheet; a cold end end cap wherein said cold end end cap is adjacent to said cold end of said shell and wherein said cold end tube sheet is not fixed to said cold end end cap and wherein a cold end tube sheet void exists between said cold end tube sheet and said cold end end cap and wherein said cold end end cap further comprises at least one cold end entry port and a high pressure inlet wherein said at least one cold end entry port connects said cold ends of said microtubes to said at least one cold end entry ports.

2. A recuperator for transferring heat between a high pressure fluid stream and a low pressure fluid stream comprising:

an annular core comprising a plurality of parallel microtubes wherein each microtube comprises a hot end and a cold end and said core further comprises a series of baffles perpendicular to said microtubes and wherein said series of baffles comprises alternating hollow baffles and solid baffles;

an outer void surrounding said annular core;

a shell surrounding said outer void wherein said shell comprises a hot end and a cold end wherein said shell further comprises a low pressure inlet at said cold end of said shell and a low pressure outlet at said hot end of said shell;

a hot end tube sheet located adjacent to said hot ends of said micotubes and wherein said microtube hot ends extend into, and are laser welded to, said hot end tube sheet;

a hot end end cap wherein said hot end end cap is adjacent to said hot end of said shell and wherein said hot end tube sheet is fixed to said hot end end cap and wherein hot end end cap further comprises at least one hot end exit port and a high pressure outlet wherein said hot end exit port connects said hot ends of said microtubes to said high pressure outlet; and wherein said hot end end cap further comprises a first hot end face seal, a second hot end face seal and a third hot end face seal wherein said first hot end seal seals a junction between the hot end exit port and the hot end tube sheet, wherein said second hot end face seal seals a junction between said hot end shell and said hot end tubesheet, and wherein said third hot end face seal seals a junction between said hot end exit port and said hot end tube sheet, a cold end tube sheet located adjacent to said cold ends of said microtubes and wherein said microtube cold ends extend into, and are laser welded to, said cold end tube sheet; a cold end end cap wherein said cold end end cap is adjacent to said cold end of said shell and wherein said cold end tube sheet is not fixed to said cold end end cap and wherein a cold end tube sheet void exists between said cold end tube sheet and said cold end end cap and wherein said cold end end cap further comprises at least one cold end entry port and a high pressure inlet wherein said at least one cold end entry port connects said cold ends of said microtubes to said at least one cold end entry ports.

3. A recuperator for transferring heat between a high pressure fluid stream and a low pressure fluid stream comprising:

an annular core comprising a plurality of parallel microtubes wherein each microtube comprises a hot end and a cold end and said core further comprises a series of baffles perpendicular to said microtubes and wherein said series of baffles comprises alternating hollow baffles and solid baffles;

an outer void surrounding said annular core;

a shell surrounding said outer void wherein said shell comprises a hot end and a cold end wherein said shell further comprises a low pressure inlet at said cold end of said shell and a low pressure outlet at said hot end of said shell;

a hot end tube sheet located adjacent to said hot ends of said micotubes and wherein said microtube hot ends extend into, and are laser welded to, said hot end tube sheet;

a hot end end cap wherein said hot end end cap is adjacent to said hot end of said shell and wherein said hot end tube sheet is fixed to said hot end end cap and wherein hot end end cap further comprises at least one hot end exit port and a high pressure outlet wherein said hot end exit port connects said hot ends of said microtubes to said high pressure outlet;

a cold end tube sheet located adjacent to said cold ends of said microtubes and wherein said microtube cold ends extend into, and are laser welded to, said cold end tube sheet;

a cold end end cap wherein said cold end end cap is adjacent to said cold end of said shell and wherein said cold end tube sheet is not fixed to said cold end end cap and wherein a cold end tube sheet void exists between said cold end tube sheet and said cold end end cap and wherein said cold end end cap further comprises at least one cold end entry port and a high pressure inlet wherein said at least one cold end entry port connects said cold ends of said microtubes to said at least one cold end entry ports, and wherein said cold end end cap further comprises a cold end cavity located at the center of said cold end end cap.

4. A recuperator for transferring heat between a high pressure fluid stream and a low pressure fluid stream comprising:

an annular core comprising a plurality of parallel microtubes wherein each microtube comprises a hot end and a cold end and said core further comprises a series of baffles perpendicular to said microtubes and wherein said series of baffles comprises alternating hollow baffles and solid baffles;

an outer void surrounding said annular core;

a shell surrounding said outer void wherein said shell comprises a hot end and a cold end wherein said shell further comprises a low pressure inlet at said cold end of said shell and a low pressure outlet at said hot end of said shell;

a hot end tube sheet located adjacent to said hot ends of said micotubes and wherein said microtube hot ends extend into, and are laser welded to, said hot end tube sheet;

a hot end end cap wherein said hot end end cap is adjacent to said hot end of said shell and wherein said hot end tube sheet is fixed to said hot end end cap and wherein hot end end cap further comprises at least one hot end exit port and a high pressure outlet wherein said hot end exit port connects said hot ends of said microtubes to said high pressure outlet;

a cold end tube sheet located adjacent to said cold ends of said microtubes and wherein said microtube cold ends extend into, and are laser welded to, said cold end tube sheet;

a cold end end cap wherein said cold end end cap is adjacent to said cold end of said shell and wherein said cold end tube sheet is not fixed to said cold end end cap and wherein a cold end tube sheet void exists between said cold end tube sheet and said cold end end cap and wherein said cold end end cap further comprises at least one cold end entry port and a high pressure inlet wherein said at least one cold end entry port connects said cold ends of said microtubes to said at least one cold end entry ports; and wherein said cold end end cap further comprises a first cold end radial seal, a second cold end radial seal and third cold end radial seal wherein said first cold end radial seal seals a junction between said cold end tube sheet and said cold end end cap, wherein said second cold end radial seal seals a junction between said cold end tube sheet and said cold end end cap, and wherein said third cold end radial seal seals a junction between said cold end cavity and said cold end end cap.

5. A recuperator for transferring heat between a high pressure fluid stream and a low pressure fluid stream comprising:

an annular core having a length and comprising a plurality of parallel laser welded microtubes wherein each microtube comprises a hot end and a cold end and wherein said microtubes are capable of transporting said high pressure fluid along said length of said core, and said core further comprises a series of baffles perpendicular to said microtubes and wherein said series of baffles comprises alternating hollow baffles and solid baffles capable of directing said low pressure fluid stream radially inwards and outwards as said lower pressure fluid stream travels along said length of said core;

a shell surrounding said core wherein said shell comprises a hot end and a cold end wherein said shell further comprises a low pressure inlet at said cold end of said shell and a low pressure outlet at said hot end of said shell;

a hot end tube sheet located adjacent to said hot ends of said micotubes and wherein said microtube hot ends extend into, and are laser welded to, said hot end tube sheet;

a hot end end cap wherein said hot end end cap is adjacent to said hot end of said shell and wherein said hot end tube sheet is fixed to said hot end end cap and wherein hot end end cap further comprises at least one hot end exit port and a high pressure outlet wherein said hot end exit port connects said hot ends of said microtubes to said high pressure outlet and wherein said hot end end cap further comprises a hollow bleed cavity capable of capturing and storing any of said fluids that may escape said core;

a cold end tube sheet located adjacent to said cold ends of said microtubes and wherein said microtube cold ends extend into, and are laser welded to, said cold end tube sheet and wherein said cold end tube sheet is capable of moving axially;

a cold end end cap wherein said cold end end cap is adjacent to said cold end of said shell and permits said axial movement of said cold end tube sheet and wherein said cold end end cap further comprises at least one cold end entry port and a high pressure inlet wherein said at least one cold end entry port connects said cold ends of said microtubes to said at least one cold end entry ports.

6. The recuperator of claim 5 wherein said hot end end cap further comprises a bleed cavity hole capable of transporting said fluids outside of said recuperator.

7. A recuperator for transferring heat between a high pressure fluid stream and a low pressure fluid stream comprising:

an annular core having a length and comprising a plurality of parallel laser welded microtubes wherein each microtube comprises a hot end and a cold end and wherein said microtubes are capable of transporting said high pressure fluid along said length of said core, and said core further comprises a series of baffles perpendicular to said microtubes and wherein said series of baffles comprises alternating hollow baffles and solid baffles capable of directing said low pressure fluid stream radially inwards and outwards as said lower pressure fluid stream travels along said length of said core;

a shell surrounding said core wherein said shell comprises a hot end and a cold end wherein said shell further comprises a low pressure inlet at said cold end of said shell and a low pressure outlet at said hot end of said shell;

a hot end tube sheet located adjacent to said hot ends of said micotubes and wherein said microtube hot ends extend into, and are laser welded to, said hot end tube sheet;

a hot end end cap wherein said hot end end cap is adjacent to said hot end of said shell and wherein said hot end tube sheet is fixed to said hot end end cap and wherein hot end end cap further comprises at least one hot end exit port and a high pressure outlet wherein said hot end exit port connects said hot ends of said microtubes to said high pressure outlet;

a cold end tube sheet located adjacent to said cold ends of said microtubes and wherein said microtube cold ends extend into, and are laser welded to, said cold end tube sheet and wherein said cold end tube sheet is capable of moving axially;

a cold end end cap wherein said cold end end cap is adjacent to said cold end of said shell and permits said axial movement of said cold end tube sheet and wherein said cold end end cap further comprises at least one cold end entry port and a high pressure inlet wherein said at least one cold end entry port connects said cold ends of said microtubes to said at least one cold end entry ports, and wherein said cold end end cap further comprises a cold end cavity capable of collecting any of said fluids that may escape said core.

* * * * *